US011809105B2

(12) United States Patent
Tsuruya et al.

(10) Patent No.: US 11,809,105 B2
(45) Date of Patent: Nov. 7, 2023

(54) FIXING APPARATUS

(71) Applicant: CANON KABUSHIKI KAISHA, Tokyo (JP)

(72) Inventors: Takaaki Tsuruya, Shizuoka (JP); Yusuke Isomi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/706,327

(22) Filed: Mar. 28, 2022

(65) Prior Publication Data

US 2022/0317603 A1 Oct. 6, 2022

(30) Foreign Application Priority Data

Mar. 31, 2021 (JP) ..... 2021-060822

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

2011/0222876 A1* 9/2011 Yuasa ..... G03G 15/2053 399/33
2016/0062285 A1* 3/2016 Yonekubo ..... G03G 15/2053 399/70

FOREIGN PATENT DOCUMENTS

JP S58152292 A 9/1983
JP H04159587 A 6/1992
JP 2011253085 A 12/2011
JP 2014026267 A 2/2014
JP 2015210203 A 11/2015
JP 2018025743 A 2/2018
JP 2020016747 A 1/2020

* cited by examiner

*Primary Examiner* — Stephanie E Bloss
*Assistant Examiner* — Michael A Harrison
(74) *Attorney, Agent, or Firm* — Canon U.S.A., Inc. I.P. Division

(57) ABSTRACT

A fixing apparatus to fix a toner image formed on a recording material to the recording material includes a rotatable member having a heat generation layer, a power supply circuit, and a control unit. The power supply circuit supplies electrical power to the rotatable member. The control unit controls supply of electrical power to the rotatable member and detects a change rate of electrical resistance of the heat generation layer. The heat generation layer generates heat by the electrical power supplied to the rotatable member, and the toner image on the recording material is fixed to the recording material by the heat from the heat generation layer. If the change rate of the electrical resistance to the supplied electrical power is higher than a predetermined threshold, the control unit stops the supply of electrical power to the rotatable member.

12 Claims, 13 Drawing Sheets

FIXING APPARATUS

BACKGROUND

Field

The present disclosure relates to fixing apparatuses installed in image forming apparatuses, such as electrophotographic copying machines and electrophotographic printers.

Description of the Related Art

Examples of the fixing apparatuses installed in electrophotographic printers and the like include a fixing apparatus that include a cylindrical film (also referred to as "belt") including a resistance heating layer and that passes a current through the resistance heating layer to cause the film to generate heat. Japanese Patent Laid-Open No. 2011-253085 discloses a fixing apparatus that includes an electric contact at an end of the film and that passes a current through the film in the direction of the rotation axis of the film to cause the film to generate heat. Japanese Patent Laid-Open No. 2014-26267 discloses an induction heating fixing apparatus that includes an energizing coil and a magnetic core in the internal space of the film and that causes the film to generate a current flowing in the circumferential direction of the film by electromagnetic induction.

A detector for detecting the temperature of the film may be disposed in the internal space of the film because a recording material may wind around the film to hinder correct measurement of temperature. Japanese Patent Laid-Open No. 2015-210203 discloses a temperature sensor disposed in contact with the film and including a thermistor element.

A film that comes into contact with a toner image on a recording material is so thin that it has low heat capacity. If the fixing apparatus is in normal operation, the film generates heat while rotating in contact with a pressure roller, which causes the heat to be sequentially removed by the member in the film, the pressure roller, and so on. Thus, the rate of temperature rise of the film is decreased by the amount of heat removed. For this reason, the temperature sensor that detects the temperature of the film tends to follow the rate of temperature rise of the film.

However, in case of an abnormality, such as when the film slips and does not rotate, the heat removed by the pressure roller and so on decreases, thereby significantly increasing the rate of temperature rise of the film. In such a case, the response of the temperature sensor falls behind the temperature rise of the film, which may cause a delay in activating the safety mechanism of the apparatus.

SUMMARY

According to an aspect of the present disclosure, a fixing apparatus to fix a toner image formed on a recording material to the recording material includes a rotatable member including a heat generation layer, a power supply circuit configured to supply electrical power to the rotatable member, and a control unit configured to control supply of electrical power to the rotatable member and to detect a change rate of electrical resistance of the heat generation layer, wherein the heat generation layer generates heat by the electrical power supplied to the rotatable member, and the toner image on the recording material is fixed to the recording material by the heat from the heat generation layer, and wherein, if the change rate of the electrical resistance to the supplied electrical power is higher than a predetermined threshold, the control unit stops the supply of electrical power to the rotatable member.

Further features of the present disclosure will become apparent from the following description of exemplary embodiments with reference to the attached drawings.

DESCRIPTION OF THE EMBODIMENTS

Embodiments

1. Description of Printer

Figure 1:
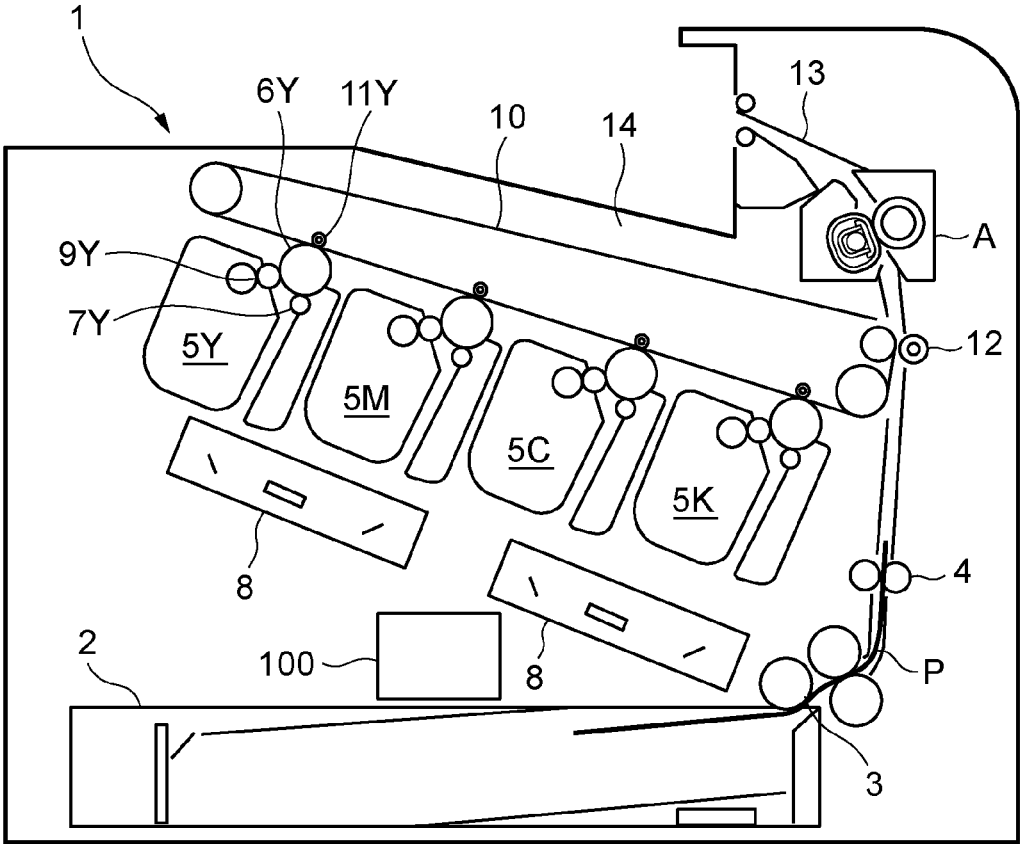
FIG. 1 is a diagram illustrating the overall configuration of an image forming apparatus

First, a printer, which is an image forming apparatus, will be described with reference to FIG. 1. The printer 1 houses a detachable cassette 2 at the lower part. The cassette 2 houses recording materials P.

The recording materials P in the cassette 2 are separated one by one by a separation roller 3 and are fed to registration rollers 4. The printer 1 includes image forming units 5Y, 5M, 5C, and 5K corresponding to yellow, magenta, cyan, and black, respectively. The image forming unit 5Y includes a photosensitive member 6Y and a charging unit 7Y that charges the surface of the photosensitive member 6Y uniformly. The photosensitive member 6Y charged by the charging unit 7Y is scanned with a laser beam according to image information, emitted from a scanner unit 8. Thus, an electrostatic latent image according to the image information is formed on the photosensitive member 6Y. The electrostatic latent image is developed by toner supplied from a developing unit 9Y. The toner image on the photosensitive member 6Y is transferred to an electrostatic transfer belt 10 at a primary transfer portion 11Y. Also in the other image forming units 5M, 5C, and 5K, a toner image is formed, and a four-color toner image superposed on the electrostatic transfer belt 10 is transferred to the recording material P at a secondary transfer portion 12. The toner image transferred to the recording material P is fixed to the recording material P by a fixing unit A. Thereafter, the recording material P is discharge to a stacking unit 14 through a conveying portion 13.

2. Description of Fixing Apparatus (Fixing Unit)

Figure 2:
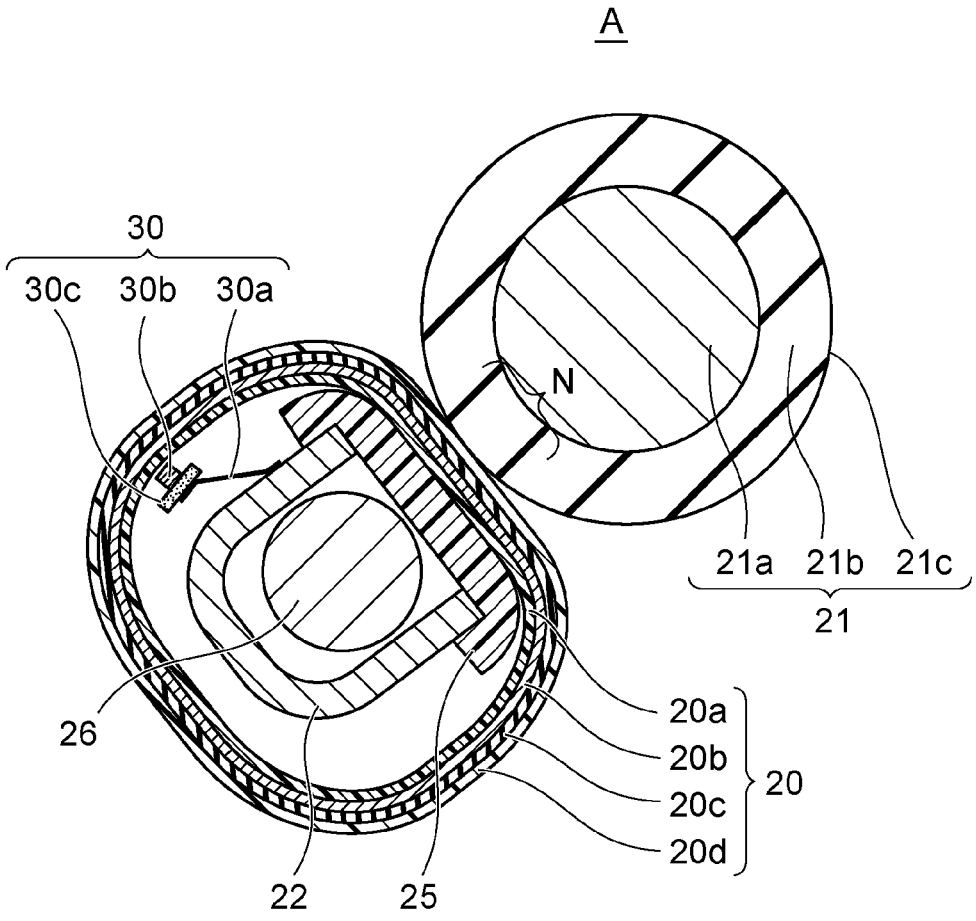
FIG. 2 is a cross-sectional view of a fixing apparatus.
Figure 3:
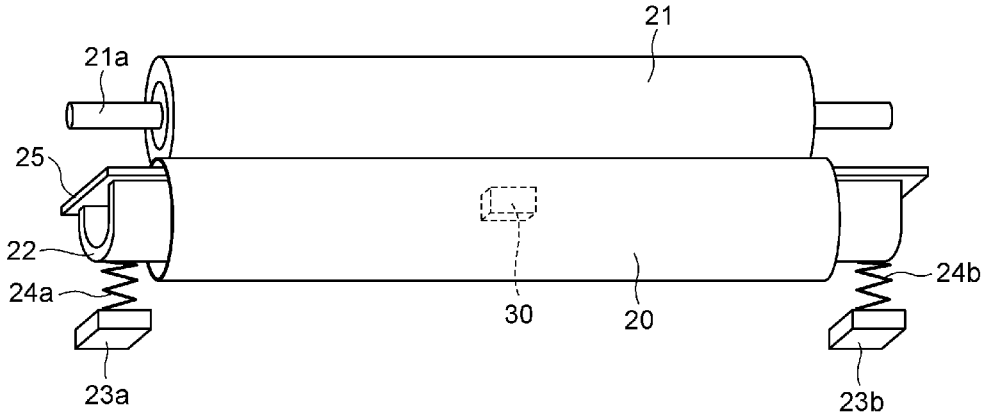
FIG. 3 is a perspective view of the fixing apparatus.

The fixing apparatus A is an electromagnetic induction heating fixing apparatus. FIG. 2 is a cross-sectional view of the fixing apparatus A. FIG. 3 is a perspective view of the fixing apparatus A.

A cylindrical fixing film (rotatable member) 20 includes a base layer 20*a*, a heat generation layer 20*b*, an elastic layer 20*c*, and a releasing layer 20*d*. The material of the base layer 20*a* is an insulating heat-resistant resin, such as polyimide, polyamidoimide, polyetheretherketone (PEEK), or polyethersulfone (PES), having an inside diameter of 30 mm, a length of 240 mm, and a thickness of about 50 μm. The material of the heat generation layer 20*b* is iron, copper, silver, aluminum, nickel, chrome, tungsten, or an alloy containing them, such as SUS304 (stainless steel) or nichrome. Other example materials include electrical conductors, such as carbon fiber reinforced plastic (CFRP) and carbon nanotube resin, whose absolute value of the temperature coefficient of resistance may be large. Examples of a method for forming the heat generation layer 20*b* include coating, plating, sputtering, and depositing. The heat generation layer 20*b* of this embodiment is formed of copper with a thickness of about 2 μm by electrolytic plating. The material of the elastic layer 20*c* may have high heat resistance and heat conductivity, such as silicone rubber, fluorine-containing rubber, or fluorosilicone rubber. The elastic layer 20*c* of this embodiment is made of silicone rubber with a thickness of about 200 μm. The material of the releasing layer 20*d* may have high releasing properties and heat resistance, such as perfluoroalkoxy (PFA), polytetrafluoroethylene (PTFE), or fluorinated ethylene propylene (FEP). In this embodiment, the releasing layer 20*d* is formed of a PFA resin tube with a thickness of about 15 μm. The inner surface of the fixing film 20 is in contact with a film guide member 25 formed of a heat-resistant resin, such as polyphenylene sulfide (PPS).

A pressure roller 21 includes a metal core 21*a* and an elastic layer 21*b* that coats the metal core 21*a* concentrically in a roller shape and further includes a releasing layer 21*c* on the surface layer. The elastic layer 21*b* may be made of a heat-resistant material, such as silicone rubber, fluorine-containing rubber, or fluorosilicone rubber.

The opposite ends of the metal core 21*a* are held by a side plate (not shown) which is part of the chassis of the fixing apparatus A via a conductive bearing. Pressure springs 24*a* and 24*b* are respectively disposed between the opposite ends of a metal stay 22 for providing the fixing apparatus A with sufficient rigidity and spring bearings 23*a* and 23*b* of the chassis so that the stay 22 is pressed toward the pressure roller 21. The fixing apparatus A of this embodiment applies a pressing force of about 100 to 300 N (about 10 to 30 kgf) in total to the stay 22. Thus, a fixing nip portion N is formed between the film guide member 25 and the pressure roller 21, with the fixing film 20 therebetween. The pressure roller 21 id driven by a motor (not shown), and the fixing film 20 is rotated with the rotation of the pressure roller 21.

Figure 4:
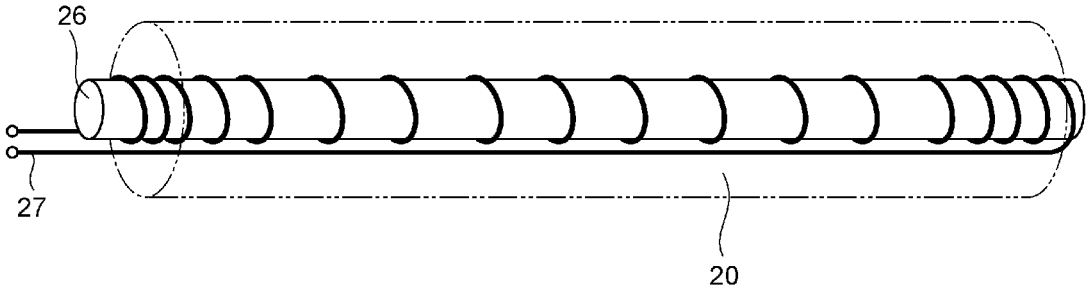
FIG. 4 is a perspective view of an energizing coil and a magnetic core.

A magnetic core 26 passes through the inner space of the stay 22 with a U-shaped cross section. FIG. 4 is a perspective view of the magnetic core 26, around which an energizing coil 27 is wound.

The magnetic core 26 has a columnar shape with ends and is disposed roughly in the radial center of the fixing film 20. Thus, the fixing film 20 houses the energizing coil 27 wound so as to form a helical portion whose helical axis is substantially parallel to the axis of the fixing film 20 and also houses the magnetic core 26 with ends disposed in the helical portion. The magnetic core 26 has a role in inducing the magnetic line (magnetic flux) of an alternating magnetic field generated by the energizing coil 27 to form a path (magnetic path) for the magnetic line. The material of the magnetic core 26 may be a material with small hysteresis loss and high relative magnetic permeability, for example, a ferromagnetic substance with high magnetic permeability, such as calcined ferrite or ferrite resin. The cross-sectional shape of the magnetic core 26 may be any shape that can be housed in the inner space of the fixing film 20 and may be as large as possible although not have to be circular. The magnetic core 26 of this embodiment is 10 mm in diameter and 280 mm in length. The energizing coil 27 is made of a copper wire (single conducting wire) having a diameter of 1 to 2 mm coated with heat-resistive polyamidoimide and is wound around the magnetic core 26 into a helical shape. The winding number is 20. The helical axis of the energizing coil 27 is parallel to the axis of the magnetic core 26. Passing a high-frequency current through the energizing coil 27 causes an inductive current to flow through the heat generation layer 20*b* to cause the heat generation layer 20*b* to generate heat on the basis of the principle described below.

The temperature of the fixing film 20 is detected by a temperature sensor 30. The temperature sensor 30 includes a leaf spring 30*a* fixed to the stay 22 at one end, a thermistor (temperature detection element) 30*b* disposed at the other end of the leaf spring 30*a*, and a sponge 30*c* interposed between the leaf spring 30*a* and the thermistor 30*b*. The surface of the thermistor 30*b* is covered with a polyimide tape 50 μm in thickness to provide electrical insulation. The sponge 30*c* functions as a heat insulator for the thermistor 30*b* and also has the function of fitting the thermistor 30*b* softly to the fixing film 20 to be measured.

The thermistor 30*b* covered with the polyimide tape is brought into contact with the inner surface of the fixing film 20 by the spring force of the leaf spring 30*a*. The output (voltage value) of the thermistor 30*b* is converted from analog to digital and is input to a control circuit (control unit) 100 (see FIG. 1). The control circuit 100 detects the temperature on the basis of the input voltage value. In fixing a toner image at a fixing nip portion N, the control unit 100 controls the electrical power to be supplied to the energizing coil 27 so that the temperature of the fixing film 20 reaches a target temperature suitable for the fixing process.

3. Description of Principle of Heating

Figure 5:
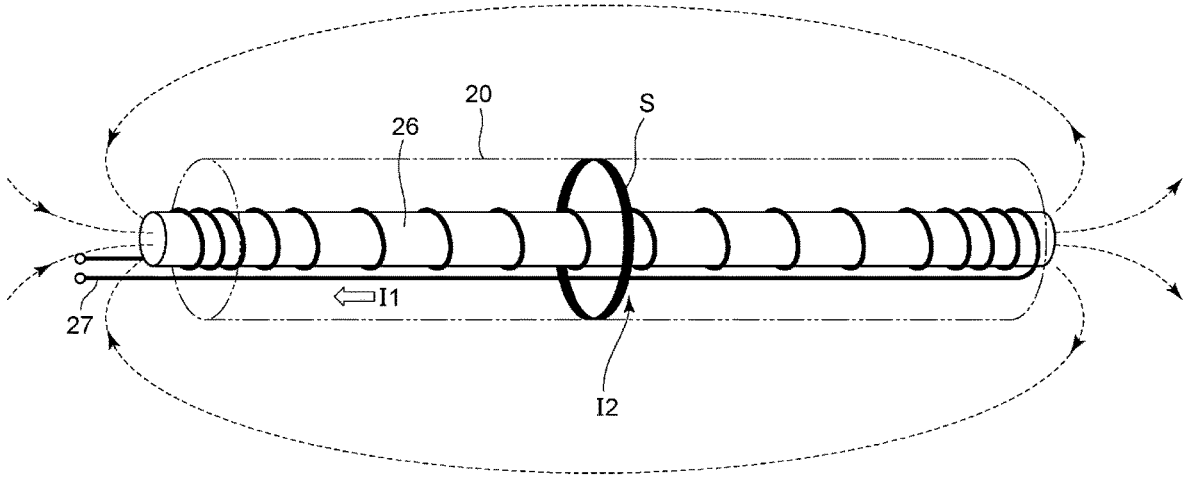
FIG. 5 is a diagram illustrating an alternating magnetic field and part of an inductive current.

FIG. 5 is a conceptual diagram illustrating the moment in time at which a current flowing in the direction of arrow I1 through the energizing coil 27 increases. When a high-frequency current is passed through the energizing coil 27, the fixing apparatus A of this embodiment forms a magnetic field in which most (90% or higher) of the magnetic flux exiting from one end of the magnetic core 26 passes outside the fixing film 20 and returns to the other end of the magnetic core 26. When such a magnetic field is formed, an inductive current is generated from (the heat generation layer 20*b* of) the fixing film 20 in the orbital direction. Reference sign S In FIG. 5 denotes part of the inductive current (orbital current) flowing around the heat generation layer 20*b*.

Thus, the fixing apparatus A includes the fixing film 20 including the heat generation layer 20*b*, a power supply circuit (FIG. 8) that supplies electrical power to the fixing film 20, and the control unit 100 that controls the supply of electrical power to the fixing film 20. The fixing apparatus A causes the heat generation layer 20*b* to generate heat with the electrical power supplied to the fixing film 20 and fixes the toner image on the recording material P to the recording material P using this heat.

4. Description of Method for Detecting Stop-Heated State

Next, a method for detecting a stop-heated state will be described. The electrical energy (electrical power) supplied from the power source is finally converted to thermal energy by Joule's heat generated from the heat generation layer 20*b* of the fixing film 20. When electrical power is supplied to the energizing coil 27 while the fixing film 20 is normally rotating, the Joule's heat generated by the orbital current flowing around the heat generation layer 20*b* raises the temperature of the pressure roller 21 and the film guide member 25 in addition to the fixing film 20 itself.

In contrast, electrical power is supplied while the fixing film 20 is not rotating, most of the thermal energy generated from the heat generation layer 20*b* raises only the temperature of the fixing film 20. In this case, the rate of temperature rise of the fixing film 20 increases significantly because the heat capacity of the fixing film 20 is small.

Figure 6:
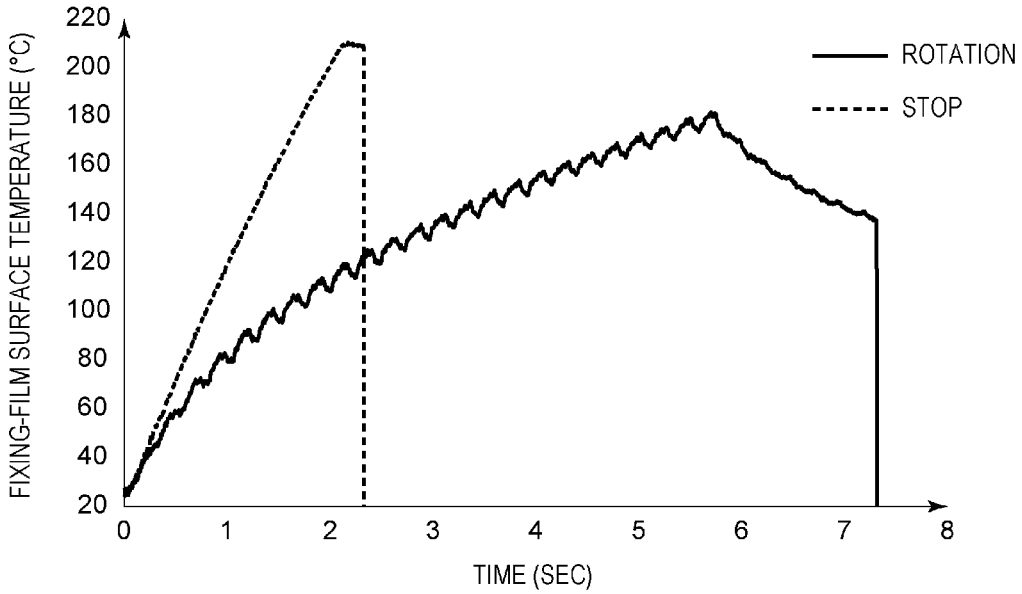
FIG. 6 is a graph showing the transition of the temperature of a fixing film.

FIG. 6 shows the transition of the temperature on the surface of the fixing film 20 when a fixed voltage is applied, in which the solid line indicates temperature transition in a normal state in which the fixing film 20 is heated while rotating (rotation-heated), and the dotted line indicates temperature transition in an abnormal state in which the fixing film 20 is heated while stopped (stop-heated). As shown in FIG. 6, the rate of temperature rise is high in the case of stop-heated. In other words, whether the fixing film 20 is in a normal state under rotation-heated or in an abnormal state under stop-heated can be determined from the rate of temperature rise of the fixing film 20. Since the heat generation layer 20*b* is made of an electrical conductor, the electrical resistance value of the heat generation layer 20*b* has temperature dependency. For this reason, finding the change rate of the electrical resistance to the supplied electrical power allows for determining whether the fixing film 20 is in a normal state under rotation-heated or an abnormal state under stop-heated.

Employing a material that changes in electrical resistance according to the temperature as a material for the heat generation layer 20*b* allows for determining whether the fixing film 20 is in an abnormal state in principle. However, if the absolute value of the temperature coefficient of resistance is low, the change rate of the electrical resistance is also low, which requires high detection accuracy for a unit for detecting the change rate of the electrical resistance. Accordingly, it is preferable that the change rate of the electrical resistance be about 10%. If the temperature coefficient of resistance is $550\times10^{-6}/°$ C., the change rate of the electrical resistance in the case of the temperature rise from 20° C. to 200° C. is about 10%. If the temperature coefficient of resistance is $1100\times10^{-6}/°$ C. or higher, its change rate is about 20%, which is more preferable. This embodiment employs copper plating for the heat generation layer 20*b*, and the temperature coefficient of resistance is about $1{,}500\times10^{-6}/°$ C.

Next, a method for finding the change rate of electrical resistance to the suppled electrical power will be described.

Figure 7:
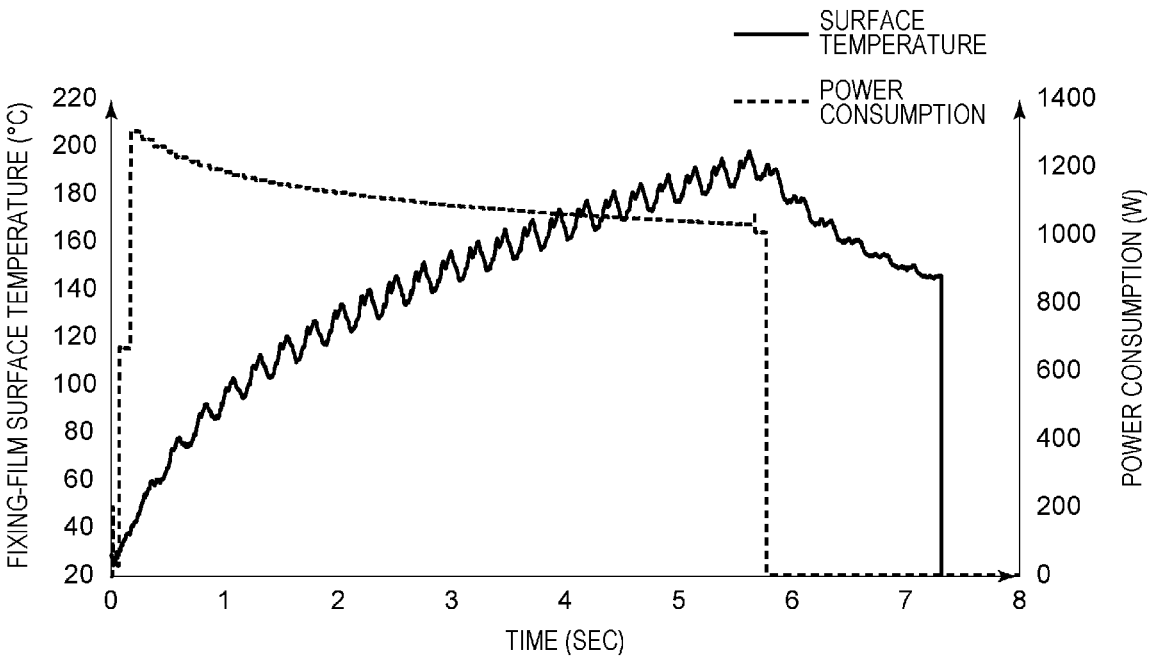
FIG. 7 is a graph showing the relationship between the temperature of the fixing film and the power consumption.

FIG. 7 shows the temporal transition of the surface temperature of the fixing film 20 (the solid line in FIG. 7) and the power consumption (the dotted line in FIG. 7) when a fixed supply voltage is applied from the power source while the fixing film 20 is being normally rotated. This shows that the temperature rises and the power consumption decreases with time. The fact that the power consumption has decreased although the applied supply voltage is fixed indicates that the electrical resistance of the fixing film 20 rises with time and that the supply current flowing through the power source decreases.

To find the electrical resistance of the fixing film 20, the film voltage and the film current applied to the fixing film 20 have to be obtained. However, a voltage detection circuit and a current detection circuit cannot be connected to the fixing film 20. However, even if the film voltage and the film current are not measured directly, the change rate of the electrical resistance of the fixing film 20 can be found if the supply voltage and the supply current can be measured.

Figure 8:
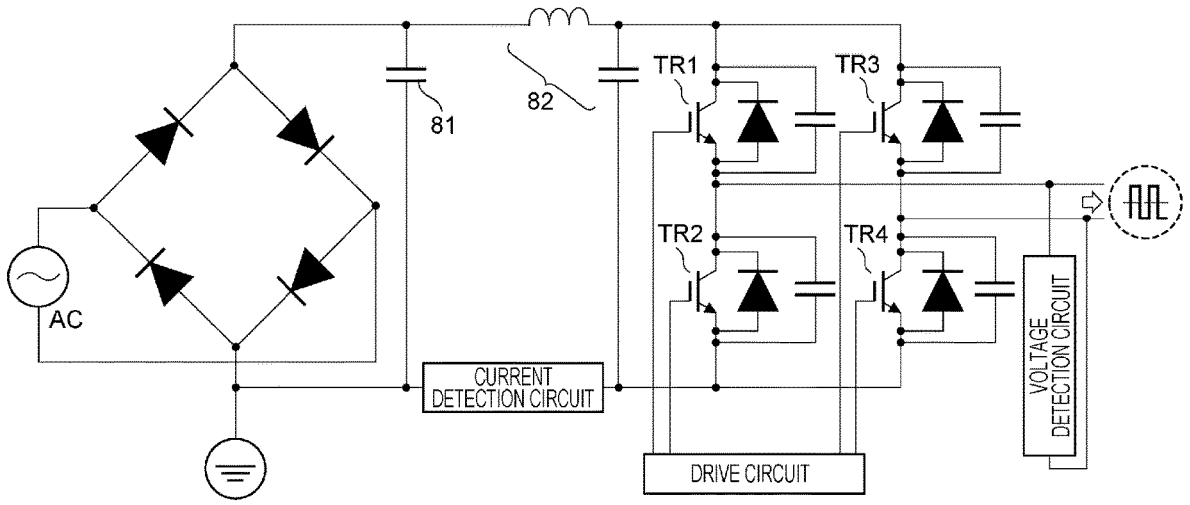
FIG. 8 is a circuit diagram of an inverter power source.

FIG. 8 is a circuit diagram of an inverter power source with a full-bridge configuration in the fixing apparatus A of this embodiment. An alternating voltage is applied to the energizing coil 27 by the inverter power source. The input voltage (commercial voltage) is full-wave rectified by a diode bridge circuit and is thereafter smoothed and converted to a direct-current (DC) voltage by a smoothing capacitor 81. The DC voltage passes through an LC noise filter 82 and is converted to a high-frequency square wave voltage by switching four transistors TR1 to TR4 serving as drive elements of tens of KHz. The temperature of the fixing film 20 is controlled by varying the drive frequency of the transistors TR1 to TR4. To increase the temperature of the fixing film 20, the drive frequency is decreased, and to decrease the temperature, the drive frequency is increased.

Disposing a current detection circuit at the GND end of the power supply circuit, as shown in FIG. 8, allows detection of the supply current (output current). Disposing a voltage detection circuit at the output end of the power supply circuit, as shown in FIG. 8, allows detection of a supply voltage output to the fixing apparatus A. Thus, the supply voltage and the supply current can be measured, which allows finding the change rate of the electrical resistance of the fixing film 20.

Figure 11:
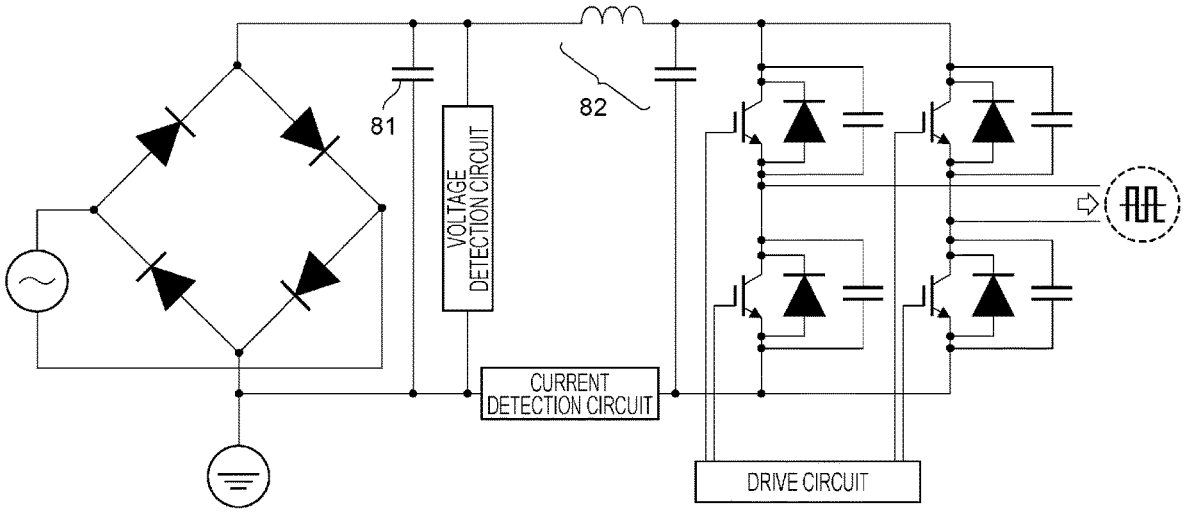
FIG. 11 is a circuit diagram of an inverter power source.

Another method for calculating the supply voltage is calculation using a voltage detection circuit disposed at another position (the position in FIG. 11) different from the output end shown in FIG. 8. First, the operation of the one or more power supply circuits shown in FIGS. 8 and 11 will be described. The difference between the circuit in FIG. 8 and the circuit in FIG. 11 is only the connection position of the voltage detection circuit.

Figure 9A:
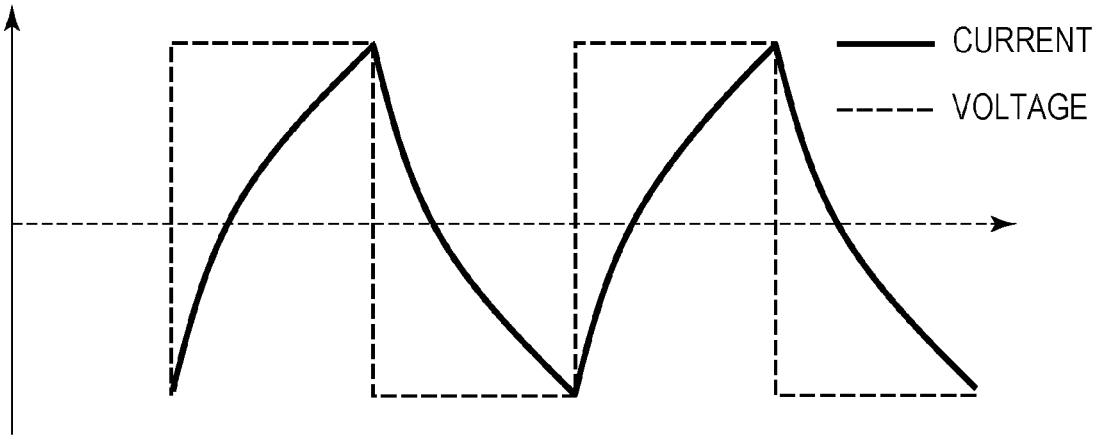
FIGS. 9A and 9B are diagrams illustrating voltage waveforms and current wave forms in a case where the drive frequency is changed.
Figure 9B:
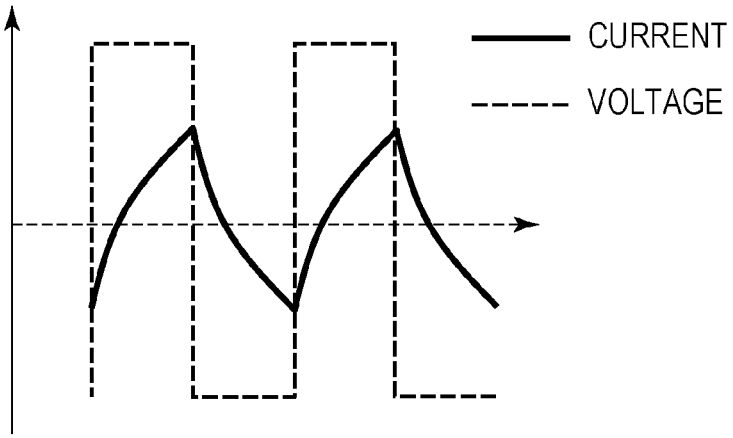

FIGS. 9A and 9B are diagrams illustrating a case where the drive frequency of the transistors TR1 to TR4 in the power supply circuit of FIG. 8 is changed, in which the dotted line indicates the voltage waveform, and the solid line indicate the current waveform. FIG. 9B shows an example in which the drive frequency is set twice as high as that of FIG. 9A. Increasing the drive frequency decreases the peak value of the current waveform and also the supplied electrical power, as in the case of decreasing the temperature of the fixing film 20. Changing the drive frequency is equivalent to changing the output voltage.

Another method for changing the output voltage is changing the duty cycle of the square wave.

Figure 10A:
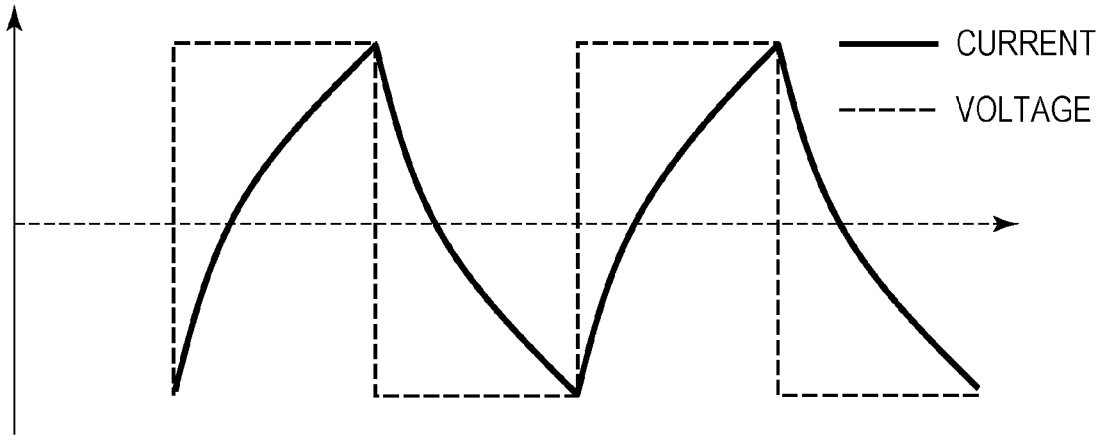
FIGS. 10A and 10B are diagrams illustrating voltage waveforms and current wave forms in a case where the drive duty cycle is varied.
Figure 10B:
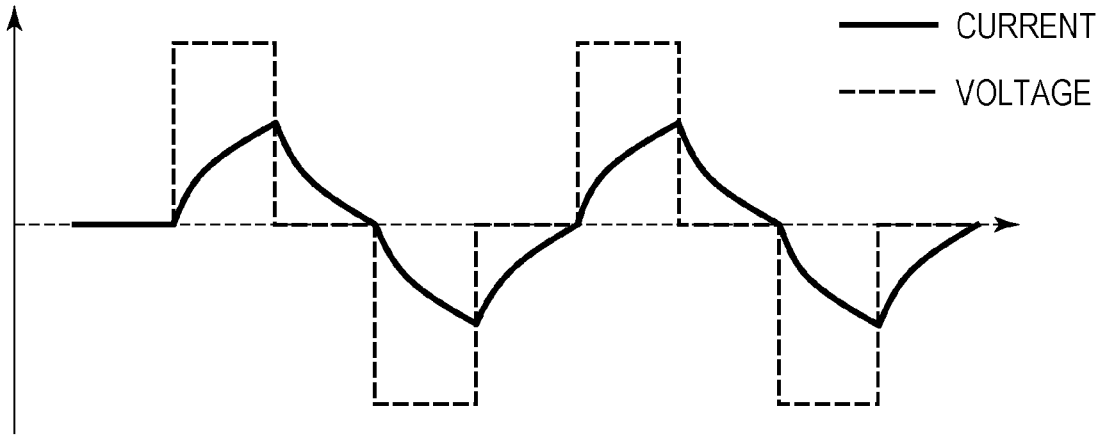

FIGS. 10A and 10B are diagrams illustrating a case where the drive duty cycle is varied, in which the dotted line indicates the voltage waveform, and the solid line indicates the current waveform. FIG. 10B illustrates an example in which the duty cycle is set half of that of FIG. 10A. Decreasing the duty cycle decreases the peak value of the current waveform and also the supplied electrical power. Changing the duty cycle is equivalent to changing the output voltage.

Next, another method for calculating the supply voltage will be described. FIG. 11 illustrates an example in which the voltage detection circuit is disposed downstream of the smoothing capacitor 81. The voltage detection circuit placed at this position detects a rectified, smoothed DC voltage, which allows easier voltage detection than that of the example in FIG. 8. The voltage value detected at this position corresponds to the peak value of the square wave, although different from the value of a finally output high-frequency square wave voltage. Accordingly, if the output voltage is varied with the drive frequency, the output voltage waveform can be estimated from the frequency and the peak value. In other words, the finally output voltage value can be calculated by combining the drive frequency information input from the drive circuit and the output of the voltage detection circuit. If the duty cycle is varied, the output voltage value can be calculated from the duty cycle information and the voltage detection result.

Figure 12:
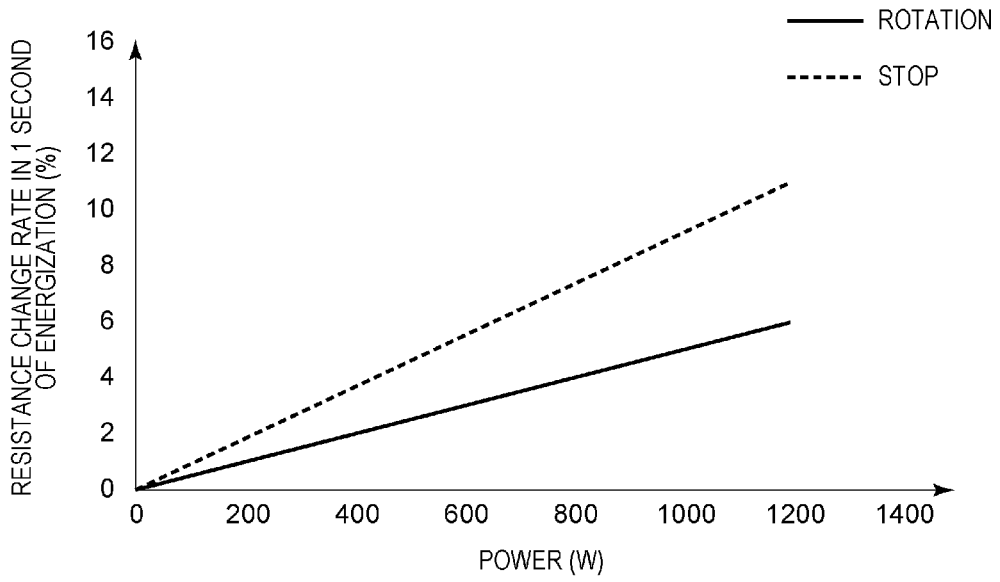
FIG. 12 is a graph showing the relationship between the electrical power and the percentage of change in resistance.

FIG. 12 shows the relationship between the electrical power calculated from the detected voltage and current and the percentage of increase in resistance in one second of energization. The solid line indicates the case of the normal state (rotation-heated state) in which the fixing film 20 generates heat while rotating, and the dotted line indicates the case of the abnormal state in which the fixing film generates heat while not rotating. This shows that the change rate of the electrical resistance in the abnormal state (stop-heated state) is higher than that in the normal state.

For this reason, the control unit 100 detects the change rate of the electrical resistance of the heat generation layer 20*b*, and if the change rate of electrical resistance to the supplied electrical power is higher than a threshold, the control unit 100 determines that the fixing film 20 is in the stop-heated state and reduces or stops the supply of electrical power to the fixing film 20.

If the electrical power supplied to the fixing film 20 is always constant, it can be determined whether the fixing film 20 is in the rotation-heated state or the stop-heated state by determining whether the change rate of the electrical resistance to the electrical power is less than a predetermined threshold. However, it is rare that constant electrical power is constantly supplied. For example, the electrical resistance value of the heat generation layer 20*b* increases with a change in temperature even at a constant voltage, which decreases consumed electrical power. For this reason, after finding the accumulated value of power for a predetermined time and calculating the average of the power, it may be determined whether the fixing film 20 is in the rotation-heated state or the stop-heated state from the change rate of electrical resistance with respect to the average electrical power.

Figure 13:
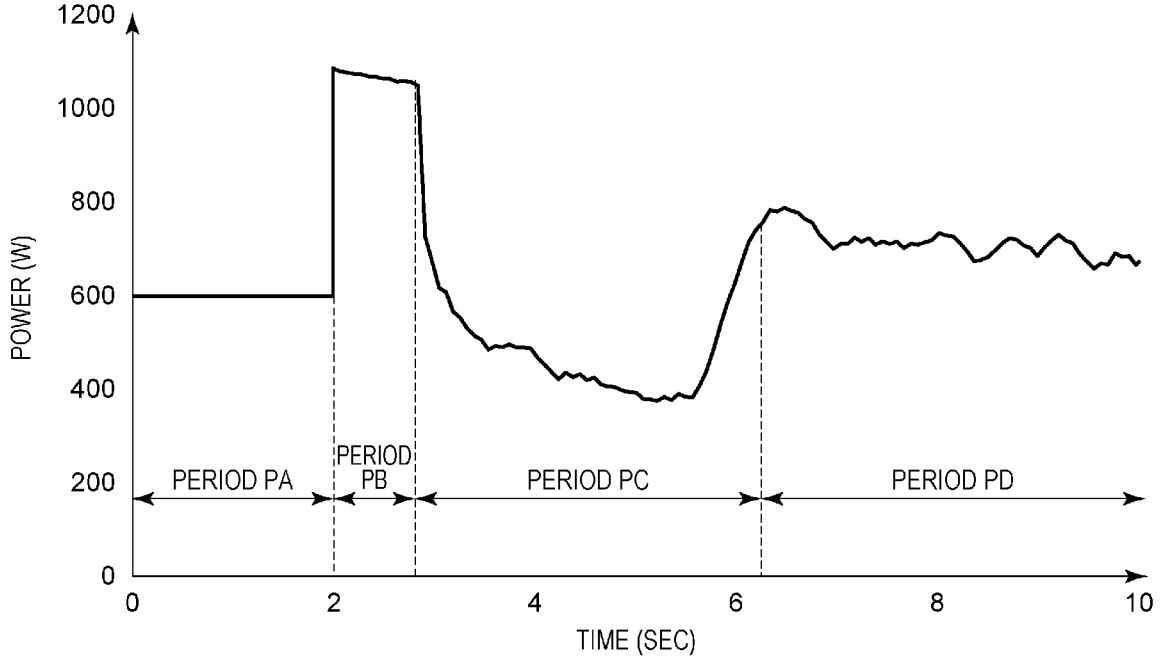
FIG. 13 is a diagram illustrating the transition of electrical power.

Alternatively, a sequence of constant power supply may be provided. For example, in adjusting the temperature of the fixing apparatus A to a predetermined temperature at the start of printing, by supplying a fixed amount of electrical power only for a predetermined time, and finding the rate of change in electrical resistance in the period, it can be determined whether the fixing apparatus A is in the rotation-heated state or the stop-heated state. FIG. 13 shows an example of electrical power transition when the power is kept constant during period PA. In inputting a print signal input to start power supply, power is output at constant 600 W for the first two seconds (period PA). The rate of change in resistance is measured during the period PA. After the period PA has passed, electrical power control aimed at the target temperature for fixing process is executed. The fixing film 20 has not reached the target temperature, the electrical power supplied at first is almost the maximum power (period PB). When the fixing film 20 reaches the target temperature, the electrical power supplied decreases (period PC). When the recording material P enters the fixing nip portion N, the heat is removed by the recording material P, and the electrical power supplied increases (period PD).

If the sequence of supplying constant electrical power is provided, it is necessary to pay attention to the amount of power to be supplied.

For example, if the electrical power to be supplied during the period PA is set to the maximum power, there is no issue when the fixing apparatus A is cool at the start of power supply. However, if the fixing apparatus is warm, the temperature of the fixing film 20 during constant power supply can become higher than the target temperature for fixing processing. In contrast, if the electrical power supplied during the period PA is excessively decreased, the rate of change in resistance also decreases, which causes an issue in detection accuracy. The higher the temperature coefficient of resistance, the easier the detection, as described above. Accordingly, if the absolute value of the temperature coefficient of resistance is $550\times10^{-6}/°$ C., the constant electrical power value is not decreased significantly. However, if the absolute value of the temperature coefficient of resistance is $1100\times10^{-6}/°$ C., sufficient detection accuracy can be provided even if the constant electrical power value is decreased to about half of the maximum electrical power. Thus, abnormal temperature rise during stop-heated can also be detected while avoiding the temperature of the fixing film 20 from becoming excessively higher than the target temperature for fixing processing.

The method for determining whether the fixing film is in the rotation-heated state or the stop-heated state is effective not only for the fixing apparatus that generates heat by non-contact power supply using electromagnetic induction but also for a fixing apparatus that generates heat by contact power supply.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-060822 filed Mar. 31, 2021, which is hereby incorporated by reference herein in its entirety.

What is claimed is:

1. A fixing apparatus to fix a toner image formed on a recording material to the recording material, the fixing apparatus comprising:

a rotatable member including a heat generation layer;

a power supply circuit configured to supply electrical power to the rotatable member; and a control unit configured to control the supply of the electrical power to the rotatable member and to detect a change rate of electrical resistance of the heat generation layer, wherein the heat generation layer generates heat by the electrical power supplied to the rotatable member, and the toner image on the recording material is fixed to the recording material by the heat from the heat generation layer, wherein an absolute value of a temperature coefficient of resistance of the heat generation layer is $550\times10^{-6}/°$ C. or higher, and wherein, if the change rate of the electrical resistance to the supplied electrical power is higher than a predetermined threshold, the control unit stops the supply of electrical power to the rotatable member.

2. The fixing apparatus according to claim 1, wherein a period in which fixed electrical power is supplied to the rotatable member is provided, and wherein, if the electrical resistance change rate in the period is higher than the predetermined threshold, the supply of electrical power is reduced or stopped.

3. The fixing apparatus according to claim 2, wherein a value of the fixed electrical power is smaller than a maximum value of the electrical power supplied from the power supply circuit.

4. The fixing apparatus according to claim 1, further comprising:

an energizing coil in the rotatable member, wherein the energizing coil is wound to form a helical portion whose helical axis is substantially parallel to an axial direction of the rotatable member; and a magnetic core having ends disposed in the helical portion, wherein the fixing apparatus causes the heat generation layer to generate a circumferential inductive current by applying an alternating voltage to the energizing coil.

5. The fixing apparatus according to claim 4, further comprising an inverter power source having a full-bridge configuration, wherein the inverter power source is connected to the energizing coil, wherein the inverter power source includes a diode bridge circuit, a smoothing capacitor, and four drive elements, wherein the diode bridge circuit and the smoothing capacitor are configured to convert an input commercial voltage to a direct-current (DC) voltage, and the four drive elements are configured to convert the DC voltage to a square wave voltage, and wherein the control unit is configured to calculate the change rate of the electrical resistance from an output voltage and an output current of the inverter power source.

6. The fixing apparatus according to claim 5, further comprising a voltage detection circuit configured to detect the DC voltage, wherein the control unit calculates the output voltage of the inverter power source from the DC voltage detected by the voltage detection circuit and a drive frequency of the four drive elements.

7. The fixing apparatus according to claim 5, a voltage detection circuit configured to detect the DC voltage, wherein the control unit is configured to calculate the output voltage of the inverter power source from the DC voltage detected by the voltage detection circuit and a drive duty cycle of the four drive elements.

8. A fixing apparatus to fix a toner image formed on a recording material to the recording material, the fixing apparatus comprising:

a rotatable member including a heat generation layer;

an energizing coil in the rotatable member, wherein the energizing coil is wound to form a helical portion whose helical axis is substantially parallel to an axial direction of the rotatable member;

a magnetic core having ends disposed in the helical portion;

an inverter power source having a full-bridge configuration, wherein the inverter power source is connected to the energizing coil; and a control unit configured to control the inverter power source to control electrical power supplied to the rotatable member and to detect a change rate of electrical resistance of the heat generation layer, wherein applying an alternating voltage to the energizing coil generates an inductive current flowing in a circumferential direction of the rotatable member, and the heat generation layer generates heat by the inductive current, wherein the heat from the heat generation layer is configured to fix the toner image on the recording material to the recording material, wherein, if the change rate of the electrical resistance to the supplied electrical power is higher than a predetermined threshold, the control unit stops the supply of electrical power to the rotatable member, wherein the inverter power source includes a diode bridge circuit, a smoothing capacitor, and four drive elements, wherein the diode bridge circuit and the smoothing capacitor are configured to convert an input commercial voltage to a direct-current (DC) voltage, and the four drive elements are configured to convert the DC voltage to a square wave voltage, and wherein the control unit is configured to calculate the change rate of the electrical resistance from an output voltage and an output current of the inverter power source.

9. The fixing apparatus according to claim 8, wherein a period in which fixed electrical power is supplied to the rotatable member is provided, and wherein, if the electrical resistance change rate in the period is higher than the predetermined threshold, the supply of electrical power is reduced or stopped.

10. The fixing apparatus according to claim 9, wherein a value of the fixed electrical power is smaller than a maximum value of the electrical power supplied from the power supply circuit.

11. The fixing apparatus according to claim 10, further comprising a voltage detection circuit configured to detect the DC voltage, wherein the control unit calculates the output voltage of the inverter power source from the DC voltage detected by the voltage detection circuit and a drive frequency of the four drive elements.

12. The fixing apparatus according to claim 10, a voltage detection circuit configured to detect the DC voltage, wherein the control unit is configured to calculate the output voltage of the inverter power source from the DC voltage detected by the voltage detection circuit and a drive duty cycle of the four drive elements.

* * * * *